US010760844B1

(12) United States Patent
Zhang et al.

(10) Patent No.: US 10,760,844 B1
(45) Date of Patent: Sep. 1, 2020

(54) HEATING CONTROL METHOD, DEVICE AND ICE MAKER

(71) Applicants: HEFEI MIDEA REFRIGERATOR CO., LTD., Hefei (CN); HEFEI HUALING CO., LTD., Hefei (CN); MIDEA GROUP CO., LTD., Foshan (CN)

(72) Inventors: Jingyu Zhang, Hefei (CN); Yu Li, Hefei (CN); Deming Wei, Hefei (CN)

( * ) Notice: Subject to any disclaimer, the term of this patent is extended or adjusted under 35 U.S.C. 154(b) by 0 days.

(21) Appl. No.: 16/706,830

(22) Filed: Dec. 9, 2019

Related U.S. Application Data

(63) Continuation of application No. PCT/CN2019/090520, filed on Jun. 10, 2019.

(30) Foreign Application Priority Data

May 17, 2019 (CN) ..... 2019 1 0410475

(51) Int. Cl.
*F25C 1/24* (2018.01)

(52) U.S. Cl.
CPC ..... *F25C 1/24* (2013.01); *F25C 2400/14* (2013.01); *F25C 2500/08* (2013.01); *F25C 2600/04* (2013.01)

(58) Field of Classification Search
CPC ..... F25C 2500/08; F25C 2400/14; F25C 2600/04
See application file for complete search history.

(56) References Cited

U.S. PATENT DOCUMENTS

| | | | | |
|---|---|---|---|---|
| 6,041,607 | A * | 3/2000 | Kim | F25C 1/25 62/188 |
| 6,810,680 | B2 * | 11/2004 | Pohl | F25C 1/04 62/420 |
| 2001/0011460 | A1 * | 8/2001 | Tchougounov | F25C 1/04 62/71 |
| 2017/0138656 | A1 | 5/2017 | Pfeiffer et al. | |
| 2018/0017308 | A1 * | 1/2018 | Yang | F25C 1/24 |

FOREIGN PATENT DOCUMENTS

| | | | |
|---|---|---|---|
| CN | 1435617 | A | 8/2003 |
| CN | 1435627 | A | 8/2003 |
| CN | 1453551 | A | 11/2003 |
| CN | 107830668 | A | 3/2018 |
| DE | 102012202790 | A1 | 8/2013 |
| KR | 20020051987 | A | 7/2002 |
| KR | 20020067176 | A | 8/2002 |
| KR | 20060039094 | A | 5/2006 |

* cited by examiner

*Primary Examiner* — David J Teitelbaum
(74) *Attorney, Agent, or Firm* — Kilpatrick Townsend & Stockton, LLP

(57) ABSTRACT

A heating control method, a heating control device, and an ice maker are provided. The heating control method is: determining that an ice maker is in the ice-making operation state, and the current water feeding is the first water feeding after a target ice maker is turned on; continuously heating a water inlet pipe for a first preset duration; controlling the water inlet valve to remain closed until the heating for the water inlet pipe ends, ensuring that no ice is present in the water inlet pipe or even if the ice is present, water can be smoothly fed into a water storage tank of the ice maker after the water inlet pipe is heated continuously for the first preset duration.

17 Claims, 3 Drawing Sheets

HEATING CONTROL METHOD, DEVICE AND ICE MAKER

CROSS-REFERENCE TO RELATED APPLICATION

The present application a continuation of International Application No. PCT/CN2019/090520, filed on Jun. 10, 2019, which claims priority to Chinese patent application No. 201910410475.0 filed on May 17, 2019, entitled "HEATING CONTROL METHOD, DEVICE AND ICE MAKER", which is incorporated herein by reference in its entirety.

FILED

The present application relates to the field of electrical intelligent control technologies, and in particular, to a heating control method, a heating control device and an ice maker.

BACKGROUND

An ice maker is a kind of ice-making mechanical equipment to produce ice by cooling water using a refrigerating agent of an ice making system through an evaporator, and the ice is manufactured by adopting the ice making system, using water as carrier through a certain apparatus in the energized state. Depending on the difference of principle and the production method of the evaporator, shapes of the generated ice cubes are also different; generally, the ice maker is divided into particle ice maker, flake ice maker, plate ice maker, tube ice maker, shell ice maker, etc. in the shapes of ice cubes.

After the end of one ice making operation, the water remaining in the inlet pipe of the ice maker is easily condensed into ice due to the cold temperature or low room temperature after the ice making operation is finished. Therefore, when the ice maker starts the next ice-making operation state, it is impossible to obtain a sufficient amount of water through the water inlet pipe for ice making, which affects the normal ice making of the ice maker. In the prior art, as long as the ice maker is in an power-on state, the heaters for the inlet water pipe are always in the heating operation state, or the heating is performed according to the on-off-ratio at fixed time, to prevent the water remaining in the inlet pipe of the ice maker being condensed into ice, which in turn affects the normal ice making of the ice maker.

Therefore, the water inlet pipe heating control technology of the ice maker in the prior art has a problem of high energy consumption.

SUMMARY

The embodiment of the present disclosure provides a heating control method, a heating control device, and an ice maker for solving the problem of high energy consumption in the water inlet pipe heating control technology of the ice maker in the prior art.

According to a first aspect of the embodiments of the present disclosure, a heating control method is provided comprising:

determining that an ice maker is in the ice-making operation state, and the current water feeding is the first water feeding after a target ice maker is turned on;

continuously heating a water inlet pipe for a first preset duration; controlling the water inlet valve to remain closed until the heating for the water inlet pipe ends; wherein, it is necessary to ensure that no ice is present in the water inlet pipe or even if the ice is present, water can be smoothly fed into a water storage tank of the ice maker after the water inlet pipe is heated continuously for the first preset duration.

According to a second aspect of the present disclosure, a heating control device is provided comprising a control module, a heater and a water inlet valve.

The control module is configured to determine that an ice maker is in the ice-making operation state, and the current water feeding is the first water feeding after a target ice maker is turned on; control the heater to continuously heat a water inlet pipe for a first preset duration; control the water inlet valve to remain closed until the heating for the water inlet pipe ends; wherein, it is necessary to ensure that no ice is present in the water inlet pipe or even if the ice is present, water can be smoothly fed into a water storage tank of the ice maker after the water inlet pipe is heated continuously for the first preset duration.

According to a third aspect of the embodiments of the present disclosure, an ice maker is provided, comprising the control device according to any one of the embodiments described above.

According to a fourth aspect of embodiments of the present disclosure, an electronic apparatus is provided, comprising a memory, a processor, and computer programs stored on the memory and executable on the processor, the processor is configured to implement steps of the heating control method according to any one of the embodiments described above when executing the computer programs.

According to a fifth aspect of embodiments of the present disclosure, a non-transitory computer readable storage medium is provided, storing computer instructions that cause the computer to perform the heating control method according to any one of the embodiments described above.

The embodiment of the present disclosure provides a heating control method, a heating control device, and an ice maker. The heating control method comprises: determining that an ice maker is in the ice-making operation state, and the current water feeding is the first water feeding after a target ice maker is turned on; continuously heating a water inlet pipe for a first preset duration; and controlling the water inlet valve to remain closed until the heating for the water inlet pipe ends. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

BRIEF DESCRIPTION OF THE DRAWINGS

In order to more clearly illustrate the technical solutions disclosed in the embodiments of the present disclosure or the prior art, the drawings used in the descriptions of the embodiments or the prior art will be briefly introduced below. Obviously, the drawings in the following description are only certain embodiments of the present disclosure, and other drawings can be obtained according to these drawings without any creative work for those skilled in the art.

DETAILED DESCRIPTION

In order to make the object, technical solutions and advantages of the embodiments of the present disclosure more clear, the technical solutions in the embodiments of the present disclosure are clearly and completely described in the following with reference to the accompanying drawings in the embodiments of the present disclosure. Obviously, the described embodiments are a part of the embodiments of the present disclosure, and not all of the embodiments. All other embodiments obtained by a person of ordinary skill in the art based on the embodiments of the present disclosure without any creative work belong to the scope of the present disclosure.

Figure 1:
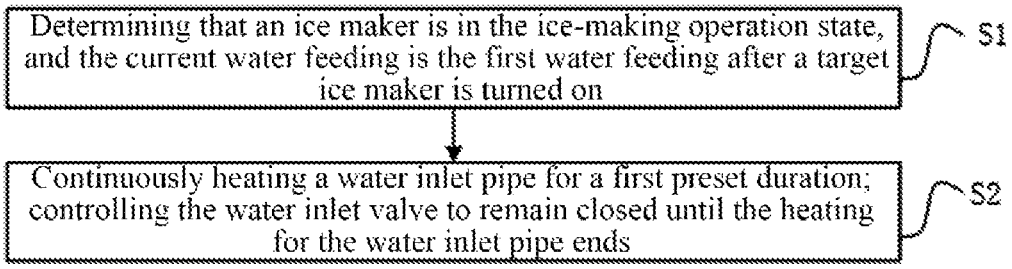
FIG. 1 is a schematic overall flow chart of a heating control method according to an embodiment of the present disclosure.

In FIG. 1, a schematic overall flow chart of a heating control method according to an embodiment of the present disclosure is shown comprising:

S1, determining that an ice maker is in the ice-making operation state, and the current water feeding is the first water feeding after a target ice maker is turned on;

S2, continuously heating a water inlet pipe for a first preset duration; controlling the water inlet valve to remain closed until the heating for the water inlet pipe ends; wherein, it is necessary to ensure that no ice is present in the water inlet pipe or even if the ice is present, water can be smoothly fed into a water storage tank of the ice maker after the water inlet pipe is heated continuously for the first preset duration.

In an embodiment of the present disclosure, in order to save energy consumption, unlike the water inlet pipe heating control technology of the ice maker in the prior art, in the embodiments of the present disclosure, when the ice maker is in an power-on state, the heaters at the water inlet pipe are not always in the heating state, and the heating operation is not performed according to the on-off-ratio at fixed time. Generally speaking, the ice maker will cause water in the water inlet pipe to be frozen before entering the ice making operation state for the first time when it is just turned on, make the water inlet pipe clogged and the water cannot enter the ice maker, which affects the ice maker for normal ice making, in the following two cases. One case is that water in the water inlet pipe is frozen due to the influence of the cold temperature after the end of the last or last few ice-making operation states; and the other case is that water in the water inlet pipe is frozen due to too low external room temperature. Usually, the ice maker does not enter the ice-making operation state at once after being turned on, and it will cause the loss of electric energy if the water inlet pipe is deiced immediately by being heated after the ice maker is turned on. At the same time, water in the water inlet pipe is possible to be frozen again before the ice maker becomes the ice-making operation state next time, which further aggravates the loss of electric energy.

Therefore, further, according to the embodiment of the present disclosure, the water inlet pipe is not heated at the first time after the ice maker is turned on, but after an instruction for entering the ice-making operation state is received, it is firstly determined that the ice maker is in the ice-making operation state and the current water feeding is the first water feeding after the target ice maker is turned on; and the heater is controlled to continuously heat the water inlet pipe for the first preset duration. In an embodiment of the present disclosure, the heater is any kind of device in the prior art for heating the water inlet pipe, and the water inlet pipe heater in the prior art is usually a heating resistor wire surrounding around the water inlet pipe. The ice maker can be determined to be in the ice-making operation state through at least the following two ways: the compressor of the ice maker is determined to be operating, or the ice maker is determined to be performing the ice-making process through the control chip of the ice maker. In an embodiment of the present disclosure, whether the current water feeding is the first water feeding or not can be determined through the following at least two ways: recorded information on the number of times a water inlet valve is controlled, or recorded information on the number of water flow at the water inlet valve is sensed. The first preset duration is predetermined, and is pre-calculated or pre-measured according to the size of the inner diameter of the water inlet pipe and the heating power of the heater; it is necessary to ensure that no ice is present in the water inlet pipe or even if the ice is present, water can be smoothly fed into a water storage tank of the ice maker after the water inlet pipe is heated continuously for the first preset duration. It should be noted that since the first preset duration is set according to the size of the inner diameter of a water inlet pipe and the calculation or measurement of the heating power of the heater, iced water inlet pipes having different sizes are heated based on a predetermined heating power during the setting of the first preset duration, a first heating duration at which the ice within the water inlet pipe melts so as to ensure that the water passes through smoothly is recorded and a second heating duration at which the ice within the water inlet pipe completely melts is recorded. At this time, a value selected from the first heating duration to the second heating duration is set as the first preset duration. Therefore, the set first preset duration can ensure that no ice is present in the water inlet pipe or even if the ice is present, water can be smoothly fed into a water storage tank of the ice maker after the water inlet pipe is heated continuously for the first preset duration.

Further, while the water inlet pipe is continuously heated, and the duration of the continuous heating does not reach the first preset duration, it is necessary to control the water inlet valve to remain closed to ensure that the water in the water inlet pipe can accelerate the melting of the ice in the water inlet pipe, thereby achieving the beneficial effect of saving energy consumption.

The specific embodiments of the present disclosure provide a heating control method comprising: determining that an ice maker is in the ice-making operation state, and the current water feeding is the first water feeding after a target ice maker is turned on; continuously heating a water inlet pipe for a first preset duration; and controlling the water inlet valve to remain closed until the heating for the water inlet pipe ends. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on the specific embodiments of the present disclosure above, a heating control method is provided further comprising:

S1', determining that an ice maker is in the ice-making operation state, and the current water feeding is not the first water feeding after the target ice maker is turned on, and the duration from the current time to the time at which the last ice-making operation state ends reaches a second preset duration;

S2', continuously heating the water inlet pipe for a first preset duration; and controlling the water inlet valve to remain closed until the heating for the water inlet pipe ends.

It should be noted that, similar to the previous embodiment, the water inlet pipe is not heated at the first time after the last ice-making operation state ends, but after an instruction for entering the ice-making operation state is received, it is firstly determined that the ice maker is in the ice-making operation state, the current water feeding is not the first water feeding after the target ice maker is turned on; and then it is determined that the duration from the current time to the time at which the last ice-making operation state ends reaches a second preset duration again. Then it is necessary to determine that the heater is controlled to continuously heat the water inlet pipe for the first preset duration after the duration from the current time to the time at which the last ice-making operation state ends reaches a second preset duration, since it takes a certain duration for the water inlet pipe to generate ice after the end of the last ice-making operation state. It should be noted that the ice maker records an ice-making start time point and an ice-making end time point every time the ice-making operation is performed. Therefore, when it is determined that the ice maker is in the ice-making operation state at the current time, the interval duration may be calculated according to the current time point and the time point at which the latest ice-making operation is ended, and then it is determined whether the interval duration reaches the second preset duration or not.

Further, the second preset duration is obtained according to experimental calculations, or calculated according to the mechanical structure of the target ice maker and the ice-making power, that is, to ensure that ice may be present in the water inlet pipe after the lapse of the second preset duration, after the target ice maker ends one ice-making operation state.

Similarly, while the water inlet pipe is continuously heated, and the duration of the continuous heating does not reach the first preset duration, it is necessary to control the water inlet valve to remain closed to ensure that the water in the water inlet pipe can accelerate the melting of the ice in the water inlet pipe, thereby achieving the beneficial effect of saving energy.

The specific embodiments of the present disclosure provide a heating control method. The heating control method comprises: determining that an ice maker is in the ice-making operation state, the current water feeding is not the first water feeding after a target ice maker is turned on, and the duration from the current time to the time at which the last ice-making operation state ends reaches a second preset duration; continuously heating a water inlet pipe for a first preset duration; and controlling the water inlet valve to remain closed until the heating for the water inlet pipe ends. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of the specific embodiments above of the present disclosure, a heating control method is provided further comprising:

determining that the ice maker is in the ice-making operation state, and the current water feeding is not the first water feeding after the target ice maker is turned on, and the duration from the current time to the time at which the last ice-making operation state ends does not reach the second preset duration; and controlling the water inlet valve to remain open until the target ice maker completes the current water feeding.

It should be noted that, similar to the embodiments above, in the embodiments of the present disclosure, the water inlet pipe is not heated at the first time after the last ice-making operation state ends, but after an instruction for entering the ice-making operation state is received, it is firstly determined that the ice maker is in the ice-making operation state, the current water feeding is not the first water feeding after the target ice maker is turned on; and then it is determined that the duration from the current time to the time at which the last ice-making operation state ends reaches a second preset duration again. It is necessary to determine that the heater is controlled to continuously heat the water inlet pipe for the first preset duration after the duration from the current time to the time at which the last ice-making operation state ends reaches a second preset duration, since it takes a certain duration for the water inlet pipe to generate ice after the end of the last ice-making operation state.

However, if the interval duration from the current time to the time at which the last ice-making operation state ends does not reach the second preset duration, it means that no ice is present in the water inlet pipe at this moment, that is, there is no need to heat the water inlet pipe.

Still further, at this time, the water inlet valve is controlled to remain open until the target ice maker completes the current water feeding to achieve the beneficial effect of saving energy consumption.

The specific embodiments of the present disclosure provide a heating control method. The heating control method comprises: determining that an ice maker is in the ice-making operation state, the current water feeding is not the first water feeding after a target ice maker is turned on, and the interval duration from the current time to the time at which the last ice-making operation state ends does not reach a second preset duration; and controlling the water inlet valve to remain open until the target ice maker completes the current water feeding. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of the specific embodiments above of the present disclosure, a heating control method is provided further comprising: after the end of the ice-making operation state, not heating the water inlet pipe until the interval duration from the current time to the time at which the last ice-making operation state ends reaches the second preset duration.

It should be noted that, similar to the last embodiments, in the embodiments of the present disclosure, the water inlet pipe is not heated at the first time after the last ice-making operation state ends. It is necessary to determine again that the heater is controlled to continuously heat the water inlet pipe for the preset duration after the interval duration from the current time to the time at which the last ice-making operation state ends reaches a second preset duration, since it takes a certain duration for the water inlet pipe to generate ice after the end of the last ice-making operation state.

Further, the second preset duration is obtained according to experimental calculations, or calculated according to the mechanical structure of the target ice maker and the ice-making power, it is needed to ensure ice may be present in the water inlet pipe after the lapse of the second preset duration, after the target ice maker ends one ice-making operation state.

Further, while the water inlet pipe is continuously heated, and the duration of the continuous heating does not reach a preset duration, it is necessary to control the water inlet valve to remain closed to ensure that the water in the water inlet pipe can accelerate the melting of the ice in the water inlet pipe, thereby achieving the beneficial effect of saving energy consumption.

The specific embodiments above of the present disclosure provide a heating control method. According to the heating control method, after the end of the ice-making operation state, the water inlet pipe is not heated until the interval duration from the current time to the time at which the last ice-making operation state ends reaches the second preset duration. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of the specific embodiments above of the present disclosure, a heating control method is provided further comprising: after the end of the ice-making operation state, not heating the water inlet pipe until the interval duration from the current time to the time at which the last ice-making operation state ends reaches the second preset duration, and then heating the water inlet pipe based on a preset time on-off ratio.

It should be noted that, the preset time on-off ratio is a ratio of a duration at which the heater is turned on to a duration at which the heater is turn off. For example, the heating is performed for 20 minutes and then the heater is turn off for 30 minutes. When the interval duration from the current time to the time at which the last ice-making operation state ends reaches the second preset duration, the heater heats the water inlet pipe based on the preset time on-off ratio. That is to say, the on time set in the on-off ratio is several data units, the water inlet pipe is heated for several data units.

It should be noted that, similar to the last embodiments, in the embodiments of the present disclosure, the water inlet pipe is not heated at the first time after the last ice-making operation state ends. Then it is necessary to determine that the heater is controlled to continuously heat the water inlet pipe for the preset duration based on a preset time on-off ratio after the interval duration from the current time to the time at which the last ice-making operation state ends reaches a second preset duration, since it takes a certain duration for the water inlet pipe to generate ice after the end of the last ice-making operation state.

The specific embodiments above of the present disclosure provide a heating control method. According to the heating control method, after the end of the ice-making operation state, not heating the water inlet pipe at the first time until the interval duration from the current time to the time at which the last ice-making operation state ends reaches the second preset duration, and then heating the water inlet pipe based on a preset time on-off ratio. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of the specific embodiments above of the present disclosure, a heating control method is provided further comprising:

determining that an ice maker is in the ice-making operation state, and the current water feeding is not the first water feeding after a target ice maker is turned on; and heating the water inlet pipe based on a preset time on-off ratio.

In an embodiment of the present disclosure, in the cycle process of one ice-making operation state, water feeding is generally performed multiple times and the multiple water feedings are continuous or have short intervals. Therefore, in this embodiment, since the water inlet pipe is continuously heated for the first preset duration before the first water feeding and water flows at the normal temperature always flows in the water inlet pipe in the ice-making operation state, it is not necessary to always heat the water inlet pipe, but heat the water inlet pipe based on the preset time on-off ratio, and thus the energy consumption is saved more under the premise that the water inlet pipe is not frozen.

Based on any one of the specific embodiments above of the present disclosure, a heating control method is provided, which heats the water inlet pipe based on the preset time on-off ratio and further comprises:

heating the water inlet pipe based on the preset time on-off ratio until a third preset duration is reached or a new ice-making operation state is entered.

It should be noted that, generally speaking, when the heating for the water inlet pipe based on the preset time on-off ratio is started, the ice has just been generated in the water inlet pipe. Therefore, heating the water inlet pipe consistently can result in excessive energy consumption. In this embodiment, one solution is that the heating for the water inlet pipe is stopped when the water inlet pipe is heated based on the preset time on-off ratio for the third preset duration. That is to say, the heater stops the heating of the water inlet pipe at a turn-on stage of the performance of the on-off ratio when it heats water inlet pipe based on the preset time on-off ratio for the third preset duration. The third preset duration is a time period in the total duration of the turn-on stage when the heater performs the on-off ratio. The third preset duration is a preset duration with the turn-on point of the turn-on stage as a timing point.

At the same time, since ice has just been generated in the water inlet pipe when the heating for the water inlet pipe based on the preset time on-off ratio is started, it is considered that deicing may be achieved by heating the water inlet pipe slightly, but when receiving the ice-making request, the ice making operation state is entered at the first time. In this embodiment, another solution is that the heating for the water inlet pipe is stopped when a new ice-making operation state is entered while the water inlet pipe is heated based on the preset time on-off ratio.

Figure 2:
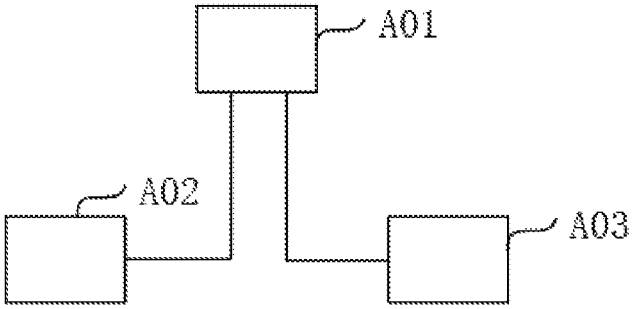
FIG. 2 is a schematic overall structural view of a heating control device according to an embodiment of the present disclosure.

As shown in FIG. 2, based on any one of the specific embodiments above of the present disclosure, a heating control device is provided, comprising a control module A0, a heater A02 and a water inlet valve A03:

the control module A01 is configured to determine that an ice maker is in the ice-making operation state, and the current water feeding is the first water feeding after a target ice maker is turned on; control the heater A02 to continuously heat a water inlet pipe for a first preset duration; control the water inlet valve A03 to remain closed until the heating for the water inlet pipe ends; wherein, it is necessary to ensure that no ice is present in the water inlet pipe or even if the ice is present, water can be smoothly fed into a water storage tank of the ice maker after the water inlet pipe is heated continuously for the first preset duration.

It should be noted that the control module can adopt a processing device such as an existing controller, a processor, and the like. The control module is connected to a heater line, sends a control command to the heater according to the heating strategy to control the heater to perform heating operation on the target part. The control module determines that the ice maker is in the ice-making operation state by confirming that the compressor of the ice maker is operating, or confirming that the ice maker is performing the ice-making process through a control chip of the ice maker. The control module is connected to a water inlet valve so as to control the opening and closing of the water inlet valve. The control module is configured to determine that whether the current water feeding is the first water feeding after the target ice maker is turned on or not based on recorded information on the number of times a water inlet valve is controlled, or recorded information on the number of water flow at the water inlet valve is sensed.

In an embodiment of the present disclosure, in order to save energy consumption, unlike the water inlet pipe heating control technology of the ice maker in the prior art, in the embodiments of the present disclosure, when the ice maker is in an power-on state, the heaters at the water inlet pipe are not always in the heating state, and the heating operation is not performed according to the on-off-ratio at fixed time. Generally speaking, the ice maker will cause water in the water inlet pipe to be frozen before entering the ice making operation state for the first time when it is just turned on, make the water inlet pipe clogged and the water cannot enter the ice maker, which affects the ice maker for normal ice making, in the following two cases. One case is that water in the water inlet pipe is frozen due to the influence of the cold temperature after the end of the last or last few ice-making operation states; and the other case is that water in the water inlet pipe is frozen due to too low external room temperature. Usually, the control module A01 does not control the heater A02 to enter the ice-making operation state at once after the ice maker is turned on, and it will cause the loss of electric energy if the water inlet pipe is deiced at the first time by being heated after the ice maker is turned on. At the same time, water in the water inlet pipe is possible to be frozen again before the ice maker becomes the ice-making operation state next time, which further aggravates the loss of electric energy.

Therefore, further, according to the embodiment of the present disclosure, the control module A01 does not control the heater A02 to heat the water inlet pipe at the first time after the ice maker is turned on, but after an instruction for entering the ice-making operation state is received, the control module A01 firstly determines that the ice maker is in the ice-making operation state and the current water feeding is the first water feeding after the target ice maker is turned on; and the control module A01 control the heater to continuously heat the water inlet pipe for the first preset duration. In an embodiment of the present disclosure, the heater A02 is any kind of device in the prior art capable of heating the water inlet pipe, and the water inlet pipe heater A02 in the prior art is usually a heating resistor wire surrounding around the water inlet pipe. In an embodiment of the present disclosure, the first preset duration is predetermined, and is pre-calculated or pre-measured according to the size of the inner diameter of the water inlet pipe and the heating power of the heater A02; it is necessary to ensure that no ice is present in the water inlet pipe or even if the ice is present, water can be smoothly fed into a water storage tank of the ice maker after the water inlet pipe is heated continuously for the first preset duration.

Further, while the control module A01 does not control the heater A02 to continuously heat the water inlet pipe, and the duration of the continuous heating does not reach the first preset duration, it is necessary to control the water inlet valve A03 to remain closed to ensure that the water in the water inlet pipe can accelerate the melting of the ice in the water inlet pipe, thereby achieving the beneficial effect of saving energy consumption.

The specific embodiments of the present disclosure provide a heating control device comprising a control module A01, a heater A02 and a water inlet valve A03: the control module A01 is configured to determine that an ice maker is in the ice-making operation state, and the current water feeding is the first water feeding after a target ice maker is turned on; control the heater A02 to continuously heat a water inlet pipe for a first preset duration; and control the water inlet valve A03 to remain closed until the heating for the water inlet pipe ends. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of the specific embodiments above of the present disclosure, a heating control device is provided in which the control module A01 is also configured to:

determining that the ice maker is in the ice-making operation state, the current water feeding is not the first water feeding after a target ice maker is turned on, and the interval duration from the current time to the time at which the last ice-making operation state ends reaches a second preset duration; control the heater A02 to continuously heat the water inlet pipe for the first preset duration; and control the water inlet valve A03 to remain closed until the heating for the water inlet pipe ends.

It should be noted that, similar to the previous embodiment, in the embodiments of the present disclosure, the control module A01 does not heat the water inlet pipe at the first time after the last ice-making operation state ends, but after the control module A01 receives an instruction for entering the ice-making operation state, it firstly determines that the ice maker is in the ice-making operation state, and the current water feeding is not the first water feeding after the target ice maker is turned on; and then it determines that the interval duration from the current time to the time at which the last ice-making operation state ends reaches a second preset duration again. Then it is necessary for the control module A01 to determine to control the heater A02 to continuously heat the water inlet pipe for the first preset duration after the interval duration from the current time to the time at which the last ice-making operation state ends reaches a second preset duration, since it takes a certain duration for the water inlet pipe to generate ice after the end of the last ice-making operation state.

Further, the second preset duration is obtained according to experimental calculations, or calculated according to the mechanical structure of the target ice maker and the ice-making power, it is needed to ensure ice may be present in the water inlet pipe after the lapse of the second preset duration after the target ice maker ends one ice-making operation state.

However, if the interval duration from the current time to the time at which the last ice-making operation state ends reaches the second preset duration, it means that no ice is present in the water inlet pipe at this moment, that is, it is unnecessary for the control module A01 to control the heater A02 to heat the water inlet pipe.

Still further, at this time, the control module A01 control the water inlet valve A03 to remain open until the target ice maker completes the current water feeding to achieve the beneficial effect of saving energy consumption.

The specific embodiments of the present disclosure provide a heating control device in which the control module A01 is also configured to: determine that an ice maker is in the ice-making operation state, the current water feeding is not the first water feeding after a target ice maker is turned on, and the interval duration from the current time to the time at which the last ice-making operation state ends reaches a second preset duration; control the heater A02 to continuously heat a water inlet pipe for a first preset duration; and control the water inlet valve A03 to remain closed until the heating for the water inlet pipe ends. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of the specific embodiments above of the present disclosure, a heating control device is provided in which the control module A01 is also configured to: after the end of the ice-making operation state, control the heater A02 to not heat the water inlet pipe until the interval duration from the current time to the time at which the last ice-making operation state ends reaches the second preset duration.

It should be noted that, similar to the embodiments above, in the embodiments of the present disclosure, the water inlet pipe is not heated at the first time after the last ice-making operation state ends. Then it is necessary for the control module A01 to determine that the heater A02 is controlled to continuously heat the water inlet pipe for the preset duration after the interval duration from the current time to the time at which the last ice-making operation state ends reaches a second preset duration, since it takes a certain duration for the water inlet pipe to generate ice after the end of the last ice-making operation state.

Still further, while the control module A01 controls the heater A02 to continuously heat the water inlet pipe, and the duration of the continuous heating does not reach a preset duration, it is necessary to control the water inlet valve A03 to remain closed to ensure that the water in the water inlet pipe can accelerate the melting of the ice in the water inlet pipe, thereby achieving the beneficial effect of saving energy consumption.

The specific embodiments of the present disclosure provide a heating control device in which the control module A01 is also configured to: after the end of the ice-making operation state, control the heater A02 to not heat the water inlet pipe until the interval duration from the current time to the time at which the last ice-making operation state ends reaches the second preset duration. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of the specific embodiments above of the present disclosure, a heating control device is provided in which the control module A01 is also configured to: after the end of the ice-making operation state, control the heater A02 to not heat the water inlet pipe until the interval duration from the current time to the time at which the last ice-making operation state ends reaches the second preset duration, and then control the heater A02 to heat the water inlet pipe based on a preset time on-off ratio.

It should be noted that, similar to the previous embodiments, in the embodiments of the present disclosure, the control module A01 does not control the heater A02 to heat the water inlet pipe at the first time after the last ice-making operation state ends. Then it is necessary for the control module A01 to determine to control the heater A02 to continuously heat the water inlet pipe for a preset duration based on a preset time on-off ratio after the interval duration from the current time to the time at which the last ice-making operation state ends reaches a second preset duration, since it takes a certain duration for the water inlet pipe to generate ice after the end of the last ice-making operation state.

Further, while the control module A01 controls the heater A02 to continuously heat the water inlet pipe, and the duration of the continuous heating does not reach the preset duration, it is necessary to control the water inlet valve A03 to remain closed to ensure that the water in the water inlet pipe can accelerate the melting of the ice in the water inlet pipe, thereby achieving the beneficial effect of saving energy consumption.

The specific embodiments of the present disclosure provide a heating control device in which the control module A01 is also configured to: after the end of the ice-making operation state, control the heater A02 to not heat the water inlet pipe until the interval duration from the current time to the time at which the last ice-making operation state ends reaches the second preset duration, and then control the heater A02 to heat the water inlet pipe based on a preset time on-off ratio. Through the embodiments of the present disclosure, the problem that the water inlet pipe heating control technology of the ice maker in the prior art has high energy consumption is solved, and the beneficial effect of precise and low-energy-consumption heating control of the water inlet pipe of the ice maker is achieved.

Based on any one of specific embodiments of the present disclosure, a heating control device is provided in which a control module A01 is also configured to: determine that an ice maker is in the ice-making operation state, and the current water feeding is not the first water feeding after a target ice maker is turned on; and control a heater A02 to heat the water inlet pipe based on a preset time on-off ratio.

In an embodiment of the present disclosure, in the cycle process of one ice-making operation state, water feeding is generally performed multiple times and the multiple water feedings are continuous or have short intervals. Therefore, in this embodiment, since the water inlet pipe is continuously heated for the first preset duration before the first water feeding and water flows at the normal temperature always flows in the water inlet pipe in the ice-making operation state, it is not necessary for the control module A01 to control the heater to always heat the water inlet pipe, but heat the water inlet pipe based on the preset time on-off ratio, and thus the energy consumption is saved more under the premise that the water inlet pipe is not frozen.

Based on any one of the specific embodiments above of the present disclosure, a heating control device is provided, in which a control module A01 is further configured to:

control a heater A02 to heat the water inlet pipe based on a preset time on-off ratio until a third preset duration is reached or a target ice maker enters new ice-making operation state.

At the same time, since ice has just been generated in the water inlet pipe when the control module A01 controls the heater A02 to start the heating for the water inlet pipe based on the preset time on-off ratio, it is considered that deicing may be achieved by heating the water inlet pipe slightly, but when receiving the ice-making request, the ice making operation state is entered at the first time. In this embodiment, another solution is that the control module A01 controls the heater A02 to stop the heating for the water inlet pipe when a new ice-making operation state is entered while the control module A01 controls the heater A02 to start the heating for the water inlet pipe based on the preset time on-off ratio.

Based on any one of the specific embodiments above of the present disclosure, an ice maker is provided, comprising the heating control device of any of specific embodiments above.

The ice maker in the prior art is divided generally into particle ice maker, flake ice maker, plate ice maker, tube ice maker, shell ice maker, etc. in the shapes of ice cubes. The type of the ice maker is not particularly limited in this embodiment, and it is the ice maker described in this embodiment as long as it includes the heating control device of any of the specific embodiments above.

Figure 3:
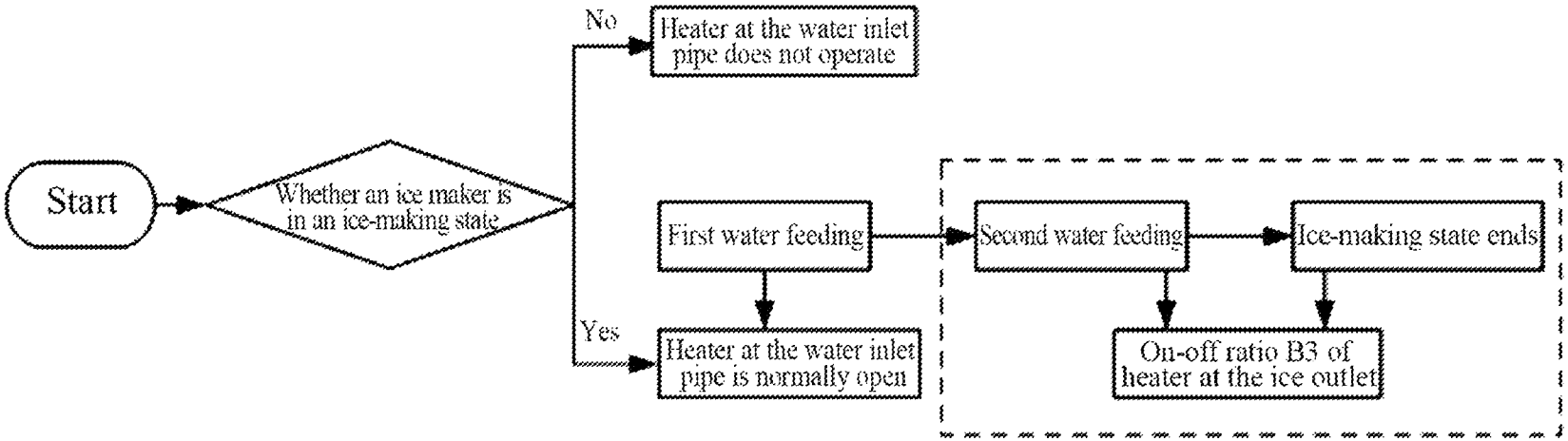
FIG. 3 is a schematic overall flow chart of another heating control method according to an embodiment of the present disclosure.

Based on any one of the specific embodiments above of the present disclosure, a heating control method is provided, as shown in FIG. 3, comprising the following steps.

When the ice maker is in a non-ice-making operation state, the heater A02 at the water inlet pipe is in a closed state;

when the ice maker is in an ice-making operation state, it determines the current water feeding is the first water feeding after the target ice maker is turned on, the heater A02 at the water inlet pipe is normally open for a preset duration, at this time, the water inlet valve A03 is closed to ensure that there is no ice blockage in the water inlet pipe at the first water feeding; the first water feeding process is completed until the ice-making cycle ends and the heater A02 at the water inlet pipe is controlled according to a fixed on-off ratio. Through the embodiments of the disclosure, the energy loss when the ice maker does not operate can be reduced while ensuring that the water inlet pipe is not blocked by ice.

When the ice maker is in a non-ice-making operation state, the heater A02 at the water inlet pipe is in a non-operating state.

when the ice maker is in an ice-making operation state, the current water feeding is the first water feeding after the target ice maker is turned on, the heater A02 at the water inlet pipe is normally open, at this time, the water inlet valve A03 is closed to ensure that there is no ice blockage in the water inlet pipe at the first water feeding; the first water feeding process is completed until the ice-making cycle ends and the heater A02 at the water inlet pipe is controlled according to a fixed on-off ratio. Through the embodiments of the disclosure, the energy loss when the ice maker does not operate can be reduced while ensuring that the water inlet pipe is not blocked by ice.

An example is taken as follows.

Figure 4:
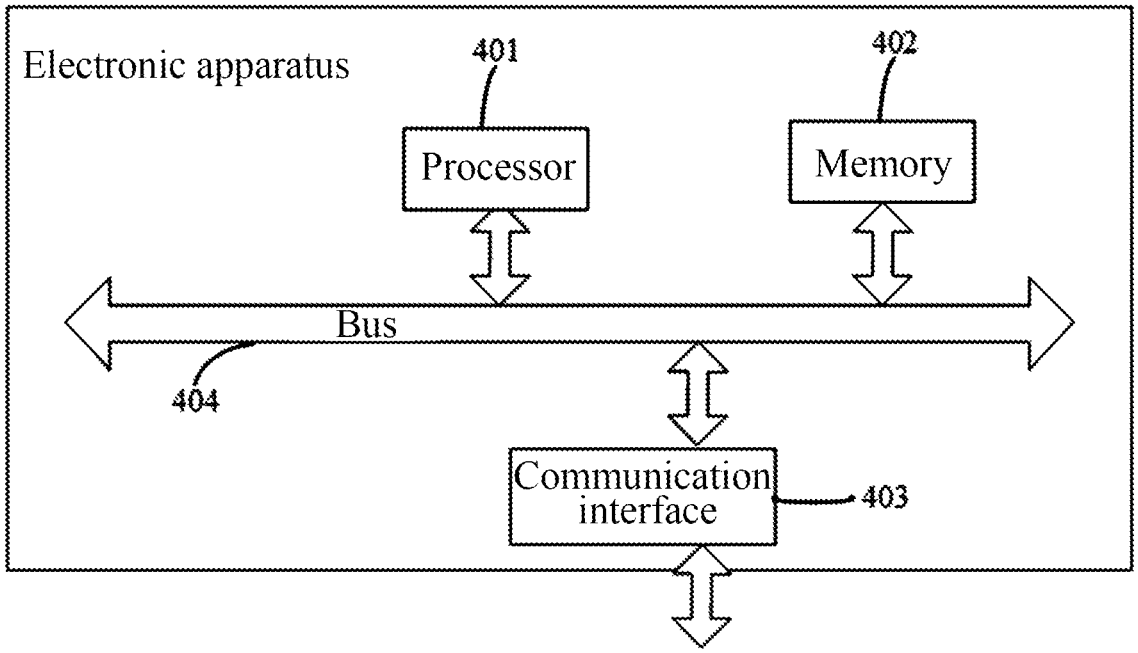
FIG. 4 is a schematic diagram of the physical structure of an electronic apparatus according to an embodiment of the present disclosure.

FIG. 4 is a schematic diagram of the physical structure of an electronic apparatus. As shown in FIG. 4, the electronic apparatus may include a processor 401, a communication interface 402, a memory 403, and a communication bus 404. The processor 405, the communication interface 406, and the memory 407 communicate with each other through the communication bus 408. The processor 401 can call logical instructions in the memory 403 to perform the following method to: determine that an ice maker is in the ice-making operation state, and the current water feeding is the first water feeding after a target ice maker is turned on; continuously heat a water inlet pipe for a first preset duration; control the water inlet valve to remain closed until the heating for the water inlet pipe ends; wherein, it is necessary to ensure that no ice is present in the water inlet pipe or even if the ice is present, water can be smoothly fed into a water storage tank of the ice maker after the water inlet pipe is heated continuously for the first preset duration.

In addition, the logic instructions in the memory 403 described above may be implemented in the form of a software functional unit and may be stored in a computer readable storage medium while being sold or used as a separate product. Based on such understanding, the technical solution of the present disclosure in substance or a part of the technical solution which contributes to the prior art, may be embodied in the form of a software product, which is stored in a storage medium and includes several instructions to cause a computer device (which may be a personal computer, server, or network device, etc.) to perform all or part of the steps of the methods described in various embodiments of the present disclosure. The storage medium described above includes various medium capable of storing program codes, including: U disk, mobile hard disk, read-only memory (ROM), random access memory (RAM), magnetic disk, or optical disk, and the like.

An embodiment of the present disclosure also provides a non-transitory computer readable storage medium in which computer programs are stored, the computer programs are executed by the processor to perform the methods provided by the embodiments above, for example, comprising: determining that an ice maker is in the ice-making operation state, and the current water feeding is the first water feeding after a target ice maker is turned on; continuously heating a water inlet pipe for a first preset duration; controlling the water inlet valve to remain closed until the heating for the water inlet pipe ends; wherein, it is necessary to ensure that no ice is present in the water inlet pipe or even if the ice is present, water can be smoothly fed into a water storage tank of the ice maker after the water inlet pipe is heated continuously for the first preset duration.

The device embodiments described above are merely illustrative, wherein the units described as separate components may or may not be physically separate, and the components displayed as units may or may not be physical units, that is, may be located at the same place, or it can be distributed to multiple network units. Some or all of the modules may be selected according to actual needs to achieve the purpose of the solution of the embodiment. Those of ordinary skill in the art can understand and implement the embodiments described above without paying creative labors.

Through the description of the embodiments above, those skilled in the art can clearly understand that the various embodiments can be implemented by means of software and a necessary general hardware platform, and of course, by hardware. Based on such understanding, the technical solution of the present disclosure in substance or a part of the technical solution which contributes to the prior art, may be embodied in the form of a software product, which is stored in a storage medium such as ROM/RAM, magnetic discs, optical discs, etc., and includes several instructions to cause a computer device (which may be a personal computer, server, or network device, etc.) to perform various embodiments or certain parts of the methods described in various embodiments.

Finally, it should be noted that the above embodiments are only used to explain the technical solutions of the present disclosure, and are not limited thereto; although the present disclosure is described in detail with reference to the foregoing embodiments, it should be understood by those skilled in the art that they can still modify the technical solutions described in the foregoing embodiments and make equivalent replacements to a part of the technical features; and these modifications and substitutions do not depart from the spirit and scope of the technical solutions of the embodiments of the present disclosure.

What is claimed is:

1. A heating control method, comprising:

determining that an ice maker is in an ice-making operation state, and a current water feeding is a first water feeding after a target ice maker is turned on;

continuously heating a water inlet pipe for a first preset duration; controlling a water inlet valve to remain closed until the heating for the water inlet pipe ends, ensuring that no ice is present in the water inlet pipe or even if the ice is present, water can be smoothly fed into a water storage tank of the ice maker after the water inlet pipe is heated continuously for the first preset duration.

2. The heating control method of claim 1, further comprising:

determining that the ice maker is in the ice-making operation state, the current water feeding is not the first water feeding after the target ice maker is turned on, and a duration from a current time to a time at which a last ice-making operation state ends reaches a second preset duration;

continuously heating the water inlet pipe for the first preset duration; and controlling the water inlet valve to remain closed until the heating for the water inlet pipe ends.

3. The heating control method of claim 1, further comprising:

determining that the ice maker is in the ice-making operation state, and the current water feeding is not the first water feeding after the target ice maker is turned on, and the duration from a current time to a time at which a last ice-making operation state ends does not reach a second preset duration; and controlling the water inlet valve to remain open until the target ice maker completes the current water feeding.

4. The heating control method of claim 1, further comprising:

after an end of the ice-making operation state, not heating the water inlet pipe until a duration from a current time to a time at which a last ice-making operation state ends reaches a second preset duration.

5. The heating control method of claim 1, further comprising:

after an end of the ice-making operation state, not heating the water inlet pipe until a duration from a current time to a time at which a last ice-making operation state ends reaches the second preset duration, and then heating the water inlet pipe based on a preset time on-off ratio.

6. The heating control method of claim 1, further comprising:

determining that the ice maker is in the ice-making operation state, and the current water feeding is not the first water feeding after the target ice maker is turned on; and heating the water inlet pipe based on a preset time on-off ratio.

7. The heating control method of claim 5, wherein the heating the water inlet pipe based on the preset time on-off ratio further comprises:

heating the water inlet pipe based on the preset time on-off ratio until a third preset duration is reached or a new ice-making operation state is entered.

8. An electronic apparatus, comprising a memory, a processor, and computer programs stored on the memory and executable on the processor, the processor is configured to implement steps of the heating control method according to claim 1 when executing the computer programs.

9. A non-transitory computer readable storage medium, storing computer instructions that cause the computer to perform the heating control method according to claim 1.

10. A heating control device, comprising a control module, a heater and a water inlet valve, wherein the control module is configured to determine that an ice maker is in an ice-making operation state, and a current water feeding is a first water feeding after a target ice maker is turned on; control the heater to continuously heat a water inlet pipe for a first preset duration; control the water inlet valve to remain closed until the heating for the water inlet pipe ends, ensuring that no ice is present in the water inlet pipe or even if the ice is present, water can be smoothly fed into a water storage tank of the ice maker after the water inlet pipe is heated continuously for the first preset duration.

11. The heating control device of claim 10, wherein the control module is further configured to:

determining that the ice maker is in the ice-making operation state, the current water feeding is not the first water feeding after the target ice maker is turned on, and a duration from a current time to a time at which a last ice-making operation state ends reaches a second preset duration; control the heater to continuously heat the water inlet pipe for the first preset duration; and control the water inlet valve to remain closed until the heating for the water inlet pipe ends.

12. The heating control device of claim 10, wherein the control module is further configured to: determine that the ice maker is in the ice-making operation state, the current water feeding is not the first water feeding after the target ice maker is turned on, and a duration from a current time to a time at which a last ice-making operation state ends does not reach a second preset duration; and control the water inlet valve to remain open until the water feeding is completed in the current ice-making operation state.

13. The heating control device of claim 10, wherein the control module is further configured to: after an end of the ice-making operation state, control the heater to not heat the water inlet pipe until a duration from a current time to a time at which a last ice-making operation state ends reaches a second preset duration.

14. The heating control device of claim 10, wherein the control module is further configured to: after an end of the ice-making operation state, control the heater to not heat the water inlet pipe until a duration from a current time to a time at which a last ice-making operation state ends reaches a second preset duration, and then control the heater to heat the water inlet pipe based on a preset time on-off ratio.

15. The heating control device of claim 10, wherein the control module is further configured to:

determine that the ice maker is in the ice-making operation state, and the current water feeding is not the first water feeding after the target ice maker is turned on; and heat the water inlet pipe based on a preset time on-off ratio.

16. The heating control device of claim 14, wherein the control module is further configured to:

control the heater to heat the water inlet pipe based on the preset time on-off ratio until a third preset duration is reached or the target ice maker enters a new ice-making operation state.

17. An ice maker, comprising the heating control device according to claim 10.

* * * * *